US006605020B1

(12) United States Patent
Huang

(10) Patent No.: US 6,605,020 B1
(45) Date of Patent: Aug. 12, 2003

(54) TREADMILL WHOSE SPEED IS CONTROLLED BY MUSIC

(76) Inventor: Chia-Shen Huang, No. 17, Lane 138, Pao Ching Road, Taoyuan City (TW)

( * ) Notice: Subject to any disclaimer, the term of this patent is extended or adjusted under 35 U.S.C. 154(b) by 0 days.

(21) Appl. No.: 10/122,226

(22) Filed: Apr. 16, 2002

(51) Int. Cl.[7] ..... A63B 21/00

(52) U.S. Cl. ..... 482/54; 482/51; 482/4; 482/7

(58) Field of Search ..... 482/51–53, 54, 482/1–10, 900–902

(56) References Cited

U.S. PATENT DOCUMENTS 5,062,632 A * 11/1991 Dalebout et al. ..... 482/7
5,888,172 A * 3/1999 Andrus et al. ..... 482/7
6,312,363 B1 * 11/2001 Watterson et al. ..... 482/54
6,447,424 B1 * 9/2002 Ashby et al. ..... 482/8
6,503,173 B2 * 1/2003 Clem ..... 482/8
6,527,674 B1 * 3/2003 Clem ..... 482/8

* cited by examiner

*Primary Examiner*—Stephen R. Crow
(74) *Attorney, Agent, or Firm*—Rosenberg, Klein & Lee

(57) ABSTRACT

The present invention relates to a treadmill whose speed is controlled by music. An audiosource is installed on the console of the treadmill. The music outputted by the audiosource passes through an amplifier and a band-pass filter takes out the frequency wave at certain range from the music, thereby avoiding unnecessary interference. Besides, a microprocessor is used to enable the driving motor of the walking belt to continuously change its speed according to the music rhythm and intensity. Moreover, the operator of the treadmill adjusts his walking speed to the music rhythm so that the speeds of the music, the motor and the operator are integrated into one speed, thereby enhancing the exercising fun without feeling tired. Furthermore, the operator can move in accordance with the music rhythm, thereby reaching the body shaping effect.

1 Claim, 5 Drawing Sheets

TREADMILL WHOSE SPEED IS CONTROLLED BY MUSIC

BACKGROUND OF THE INVENTION

1. Field of the Invention

The present invention relates to a speed control device of an electric treadmill, and more particularly, to a treadmill in which the walking speed can be controlled by rhythm and intensity of music.

2. Description of the Prior Art

Since the living space in the big cities becomes smaller and smaller so that the place for walking becomes less and less. Moreover, the busy life in the modern time leads to having less time for exercise. Thus, the health is much influenced.

Accordingly, a treadmill for indoor exercise was developed. According to related reports, the treadmill is one of the most popular exercisers. The conventional passive type treadmill has been replaced by electric treadmills degree by degree. The walking belt is driven by a motor while the rotational speed of the motor can be adjusted by operators in accordance with their personal needs.

However, the way to adjust the rotational speed of motor is no other than the electrical control by changing the voltage or current or the mechanic control by shifting, magnetic and braking mechanisms. Regardless of which mode is used to control the speed of the walking belt, it is operated at a certain preset speed. When the operator uses it for a longer time, he will find that it's monotone, thereby being tired of this kind of exercise and not reaching the expected body shaping effect.

SUMMARY OF THE INVENTION

It is a primary object of the present invention to provide a speed control device of an electric treadmill whose driving motor changes its speed according to the rhythm and the intensity of music while the operator adjusts his speed to the music rhythm so that the speed of music, motor and operator is identical to one another, thereby enhancing the exercise fun and not having the tired feeling.

It is another object of the present invention to provide a speed control device of an electric treadmill in which the music controlling the rotational speed of the motor can be sent to a headphone of the operator in the way of infrared transmission. Accordingly, the operator can be fully integrated into the music rhythm without being interfered by outside noise during the exercise session, thereby reaching the effect of combination of listening to music and taking exercise.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
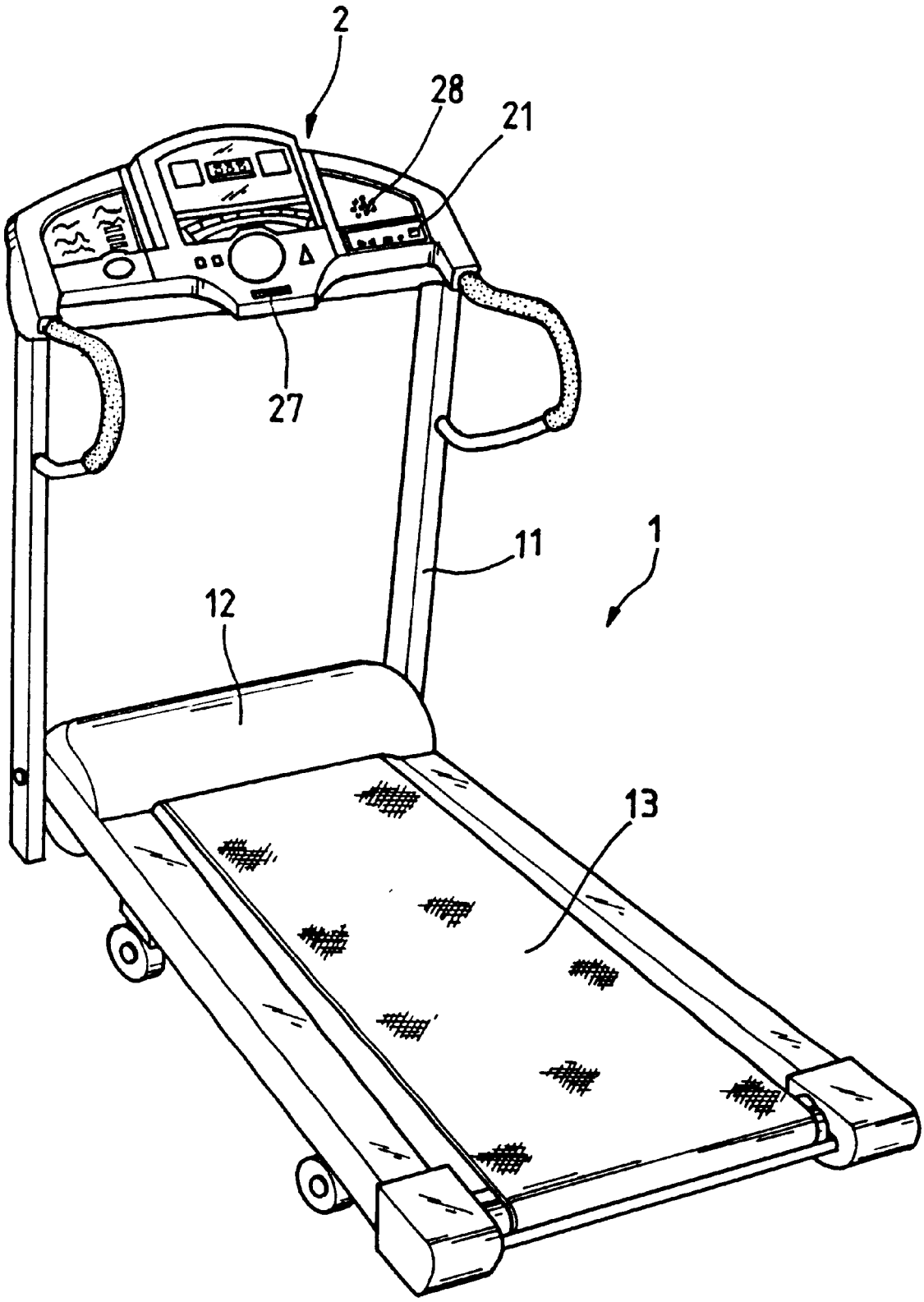
FIG. 1 is a perspective view of an applicable embodiment of the present invention.
Figure 2:
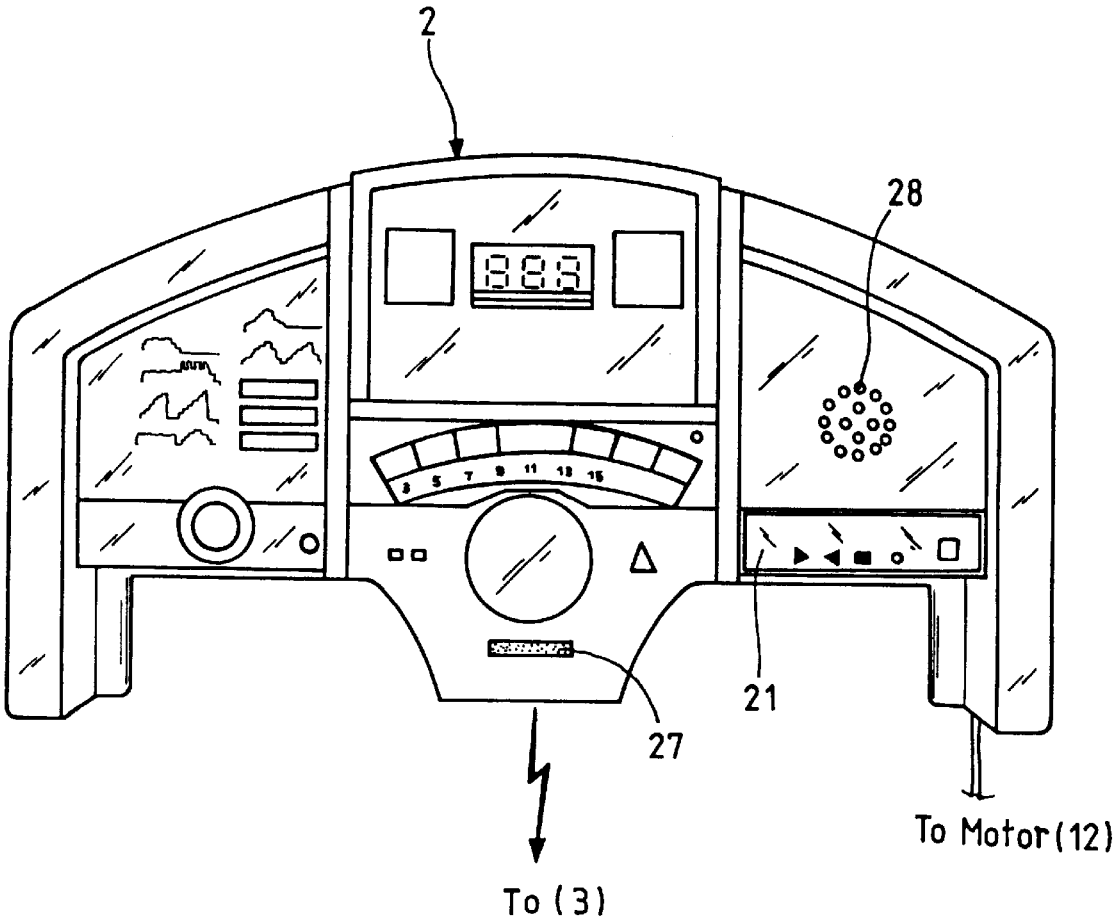
FIG. 2 is a schematic drawing of a console of the applicable embodiment of the present invention.
Figure 3:
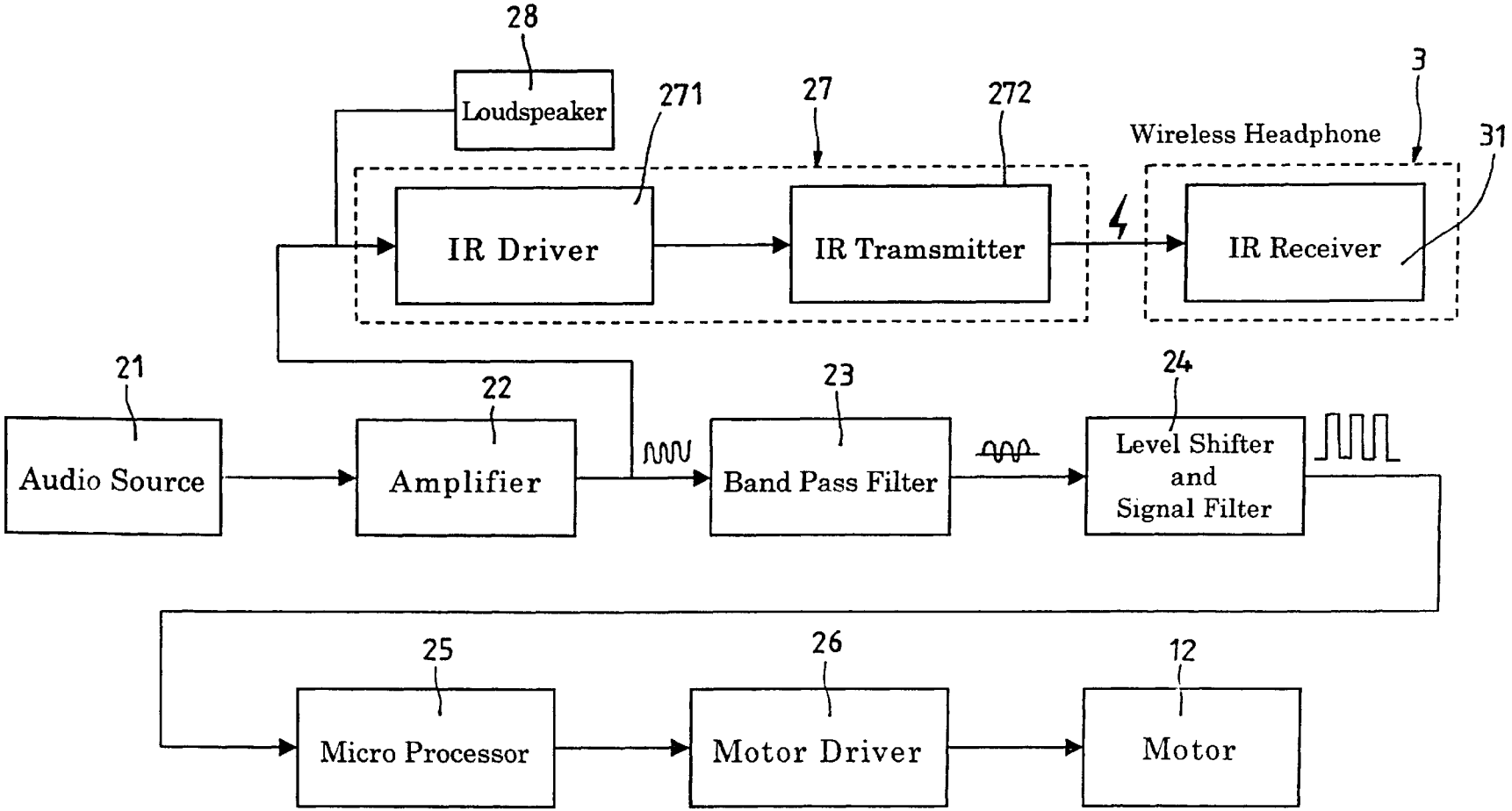
FIG. 3 is a block diagram of the speed adjustment of the applicable embodiment of the present invention.

First of all, referring to FIGS. 1 through 3, the present invention includes a treadmill 1 and a console 2. The treadmill 1 utilizes a motor 12 disposed at the bottom end of upright frame 11 to drive a walking belt 13 in rotation. The console 2 is installed at the top of the upright frame 11 and used to control the treadmill's operation and to show numerical values and drawings with respect to the exercise state.

Furthermore, the console 2 includes an audiosource 21, an amplifier 22, a band-pass filter 23, a level shifter and signal filter 24, a microprocessor 25 and a music signal sender 27. The audiosource 21 can be CD player, radio, etc. and is installed at a proper place facilitating the operation. The amplifier 22 is connected with the audiosource 21 and amplifies music signal for output. The band-pass filter 23 containing an op-amp together with resistance and capacitance takes out the music signals within certain range of frequency, thereby suppressing other signals than the central frequency waves (that is, removing other signal waves). The preset frequency wave will be outputted while the other will be attenuated. By means of the feature of the present invention that only music rhythm signals are received while the human sound is removed, thereby avoid the improper operation. The level shifter and signal filter 24 amplifies and reshapes the music frequency wave passing through the band-pass filter 23. Thereafter, the music rhythm and the intensity signal are brought into the microprocessor 25. After analysis and processing of the input music rhythm and the intensity signal by the microprocessor 25, the rotational speed of the motor 12 is controlled by a motor driver 26. The audio signal sender 27 comprises an IR driver 271 and an IR transmitter 272. The IR driver 271 is connected to the output port of the amplifier 22. Thus, the signal outputted by the audiosource 21 will be sent to an IR receiver 31 in the way of wireless transmission.

Figure 4:
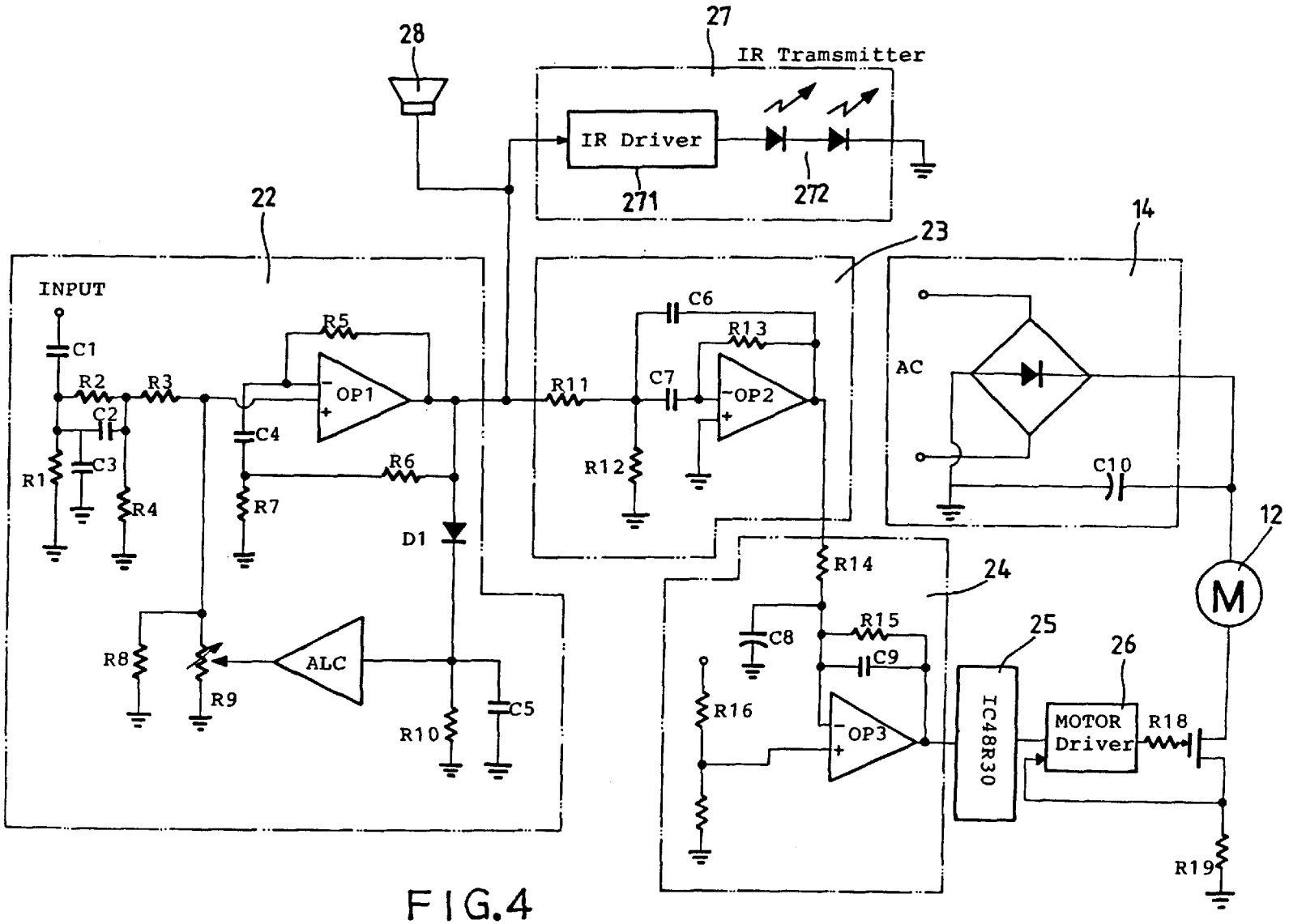
FIG. 4 is a circuit diagram of the speed adjustment of the applicable embodiment of the present invention.

FIG. 4 shows a circuit diagram of the speed adjustment of the applicable embodiment of the present invention. The amplifier 22 consists of an op1 amp, an ALC-amplifier, resistances R1–R10, capacitances C1–C5 and a diode D1. The band-pass filter 23 consists of op2 amp, resistances R11–R13 and capacitances C5–C6. The level shifter and signal filter 24 consists of op3 amp, resistances R15–R17 and a capacitance C8. The microprocessor 25 can be IC48R30 or the like. The motor driver 26 in combination with resistances R18–R19 is used to activate the motor 12. The AC current is fed through a rectifier circuit 14 to the motor 12 for the operation thereof. The audio signal sender 27 consists of IR driver 271 and LEDs D2, D3. Based upon the above-mentioned, the one who is acquainted with this technique should have no difficulty in use.

Figure 5:
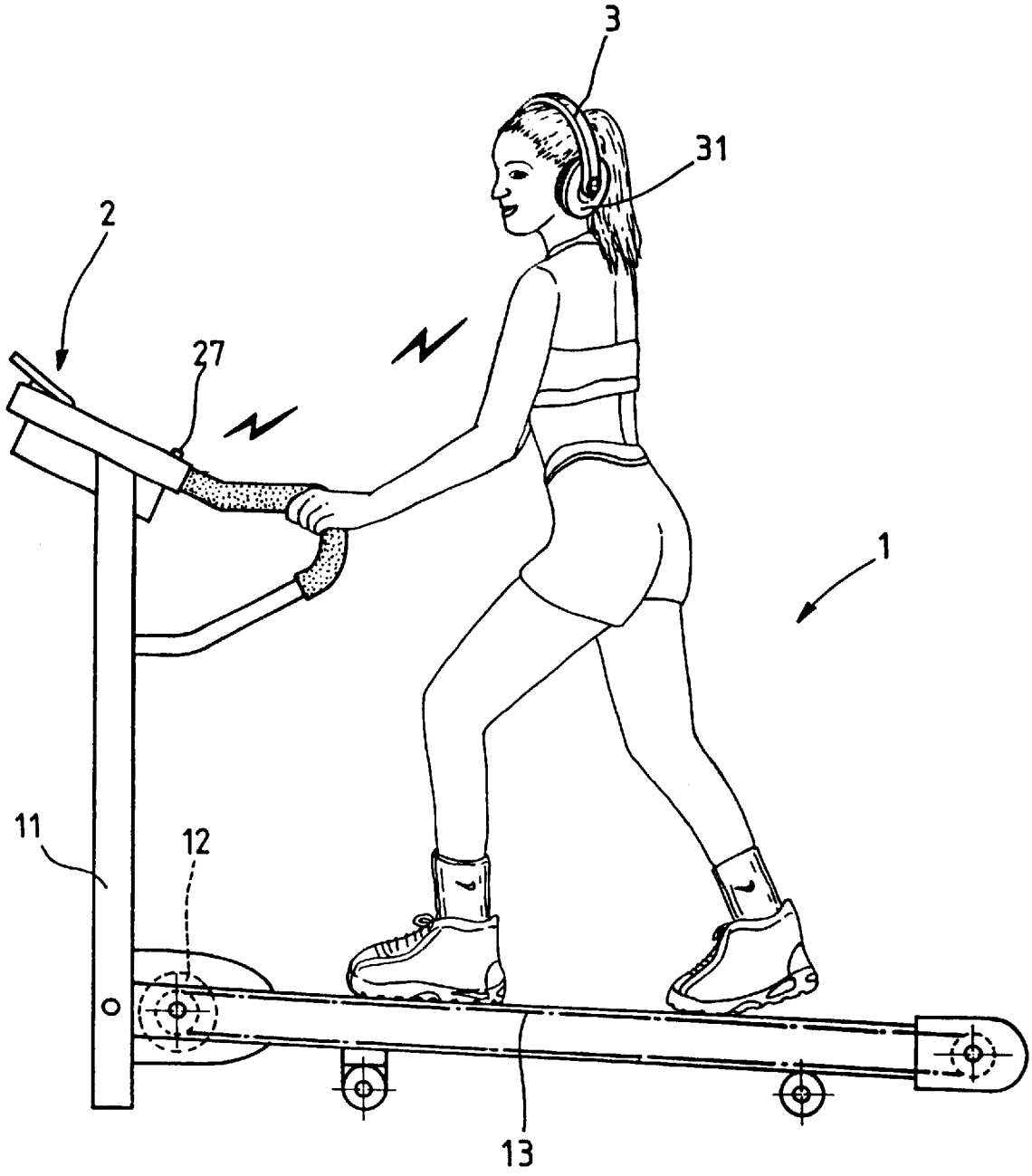
FIG. 5 is an example of use of the present invention.

FIG. 5 shows an example of use of the present invention. It's apparent from FIG. 5 together with FIG. 3 that the music signals will be amplified by the amplifier 22 when the audiosource 21 of the console 2 sends them out. Thereafter, the band-pass filter 23 takes the frequency wave at certain range in such a way that the singer's sound in the music is removed and only certain signals pass therethrough. Accordingly, the microprocessor 25 can receive amplified music rhythm and intensity signals. After they are analyzed and processed, the rotational speed of the motor 12 is controlled.

In other words, the rapider and stronger is the music rhythm outputted by the audiosource 21, the faster is the rotational speed of the motor 12. When the operator listens to the rapid rhythm music, he will increase his walking speed. Therefore, the speed of the treadmill 1 during the music playing is continuously changed according to the music rhythm while the operator adjusts his walking speed to the music rhythm so that the three speeds of the music, the motor and the operators are integrated into one speed. Thus, the operator doesn't feel boring during the exercise session. Moreover, the speed of the treadmill is changeable with the music, unlike that the conventional treadmill has only fixed speed and the operator walks like a machine. Consequently, it's not easy for the operator to feel tired. Besides, the whole body moves with the music rhythm so that the body shaping effect can be reached.

Furthermore, as shown in FIG. 3, the console 2 of the present invention is provided with a loudspeaker 28 in order to directly output the music of the audiosource 21. However, the motor 12 and the walking belt 13 of the treadmill 1 will produce noise during the exercise session. Besides, a plurality of treadmills in the fitness center are arranged in row. In order not to be disturbed by or interfered with one another, the present invention, as shown in FIG. 5, utilizes the audio signal sender 27 to send the music to the headphone 3 in a wireless transmission way and to receive the music not disturbed by the outside. Due to the wireless transmission, there is no problem with the cable connection so that the operator has more freedom to move his whole body and reaches the body shaping effect and enjoys the exercise.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claim.

What is claimed is:

1. A treadmill whose speed is controlled by any desired music comprising:

an electric treadmill having a motor disposed at the bottom end of an upright frame to drive a walking belt in rotation; and a console installed at the top of the upright frame and used to control the treadmill's operation and to show numerical values and drawings with respect to the exercise state;

wherein the improvement is characterized by said console having:

an audiosource being an audiosource device for output sound and installed at a proper place facilitating the operation;

an amplifier connected with said audiosource and amplifying any desired music signal for output;

a band-pass filter taking out the music signals being within certain range of frequency and outputted by said amplifier;

a level shifter and signal filter amplifying and reshaping the music frequency wave passing through said band-pass filter whereupon the music rhythm and the intensity signal are brought into a microprocessor;

a microprocessor analyzing and processing the input music rhythm and the intensity signal a motor drive which receives the intensity signal from said microprocessor, the rotational speed of said motor being controlled by said motor driver;

an audio signal sender having an IR driver and an IR transmitter, said IR driver being connected to the output port of said amplifier so that the signals outputted by the audiosource are sent to an IR receiver in the way of wireless transmission.

* * * * *